United States Patent [19]

Fulton

[11] Patent Number: 4,645,462

[45] Date of Patent: Feb. 24, 1987

[54] TROLLING MOTOR GUIDE

[76] Inventor: Hubert S. Fulton, 1400 Park Rd., Bessemer, Ala. 35023

[21] Appl. No.: 735,152

[22] Filed: May 17, 1985

[51] Int. Cl.[4] ..... B63B 17/00

[52] U.S. Cl. ..... 440/6; 114/363; 74/480 B

[58] Field of Search ..... 440/6, 7; 114/144 R, 114/363; 74/63, 480 B; 244/222

[56] References Cited

U.S. PATENT DOCUMENTS

| | | | |
|---|---|---|---|
| 1,133,788 | 3/1915 | Bassford | 114/144 A |
| 1,634,257 | 7/1927 | Garro | 114/144 A |
| 2,666,407 | 1/1954 | Wilkirson | 74/480 B |
| 2,845,891 | 8/1958 | Frey | 114/144 A |
| 2,989,021 | 6/1961 | Meloche | 114/144 R |
| 3,002,398 | 10/1961 | Beamer | 440/63 |
| 4,143,436 | 3/1979 | Jones | 114/363 |
| 4,553,496 | 11/1985 | Foresman | 114/144 R |

*Primary Examiner*—Galen L. Barefoot
*Assistant Examiner*—Stephen P. Avila
*Attorney, Agent, or Firm*—Jennings, Carter, Thompson & Veal

[57] ABSTRACT

A steering apparatus for a trolling motor utilizes a rotatable pedestal to support a boat occupant seat. The seat is detachably connected to the pedestal for rotation therewith and the pedestal is connected to the trolling motor by a control cable for changing the direction of the motor.

3 Claims, 5 Drawing Figures

TROLLING MOTOR GUIDE

BACKGROUND OF THE INVENTION

The present invention relates to boats using steerable trolling motors and more particularly to a means for steering such a motor which leaves the occupant of the boat free to use his hands. Even more particularly my invention may be described as a seat controlled means for steering the motor.

The modern fishermen, particularly bass fishermen, are no longer content to float lazily along in pursuit of their angling pleasure. Since at least the late 1960's, these fishermen have used lightweight battery powered electric motors, commonly termed trolling motors, to move their boats across the water. The early trolling motors were manually steerable by means of a handle similar to that common to manually steerable outboard motors. Inasmuch as the fishermen also prefer to use spin-casting or bait casting fishing gear, the manual steering feature was not very convenient because two hands are necessary to operate the fishing gear and one hand is necessary to steer the trolling motor. A solution to this problem was provided by foot controlled trolling motors. These motors utilize a pivotally mounted foot plate attached to one end of a control cable which is attached at its opposite end to the motor and which steers the motor in response to pressure applied to the foot pedal by the operator. This system is adequate in its intended function; however it, too, limits the freedom of movement of the operator.

SUMMARY OF THE INVENTION

It is an object of the present invention to provide a trolling motor steering mechanism which gives the fisherman/operator maximum freedom of movement in his boat.

Another object of the invention is to allow the fisherman/operator to face in a selected direction while fishing without moving his control apparatus from one side of the boat to the other.

To accomplish these objectives my invention utilizes the seat mounting structure of the boat. The seat in the typical fishing boat is pedestal mounted for rotation (about a vertical axis), so that the fisherman may turn in any direction he wishes. To allow the fisherman unfettered mobility, I attach a steering cable to a steering arm which moves in the same arc as the seat. I also provide a release mechanism which allows the seat to turn without displacing the steering arm, thus the fisherman is then free to turn without altering the course of the boat or without moving the motor when the motor is not on.

DESCRIPTION OF THE DRAWINGS

Apparatus embodying features of my invention are illustrated in the accompanying drawings which form a portion of this application wherein.

DESCRIPTION OF THE PREFERRED EMBODIMENT

Figure 1:
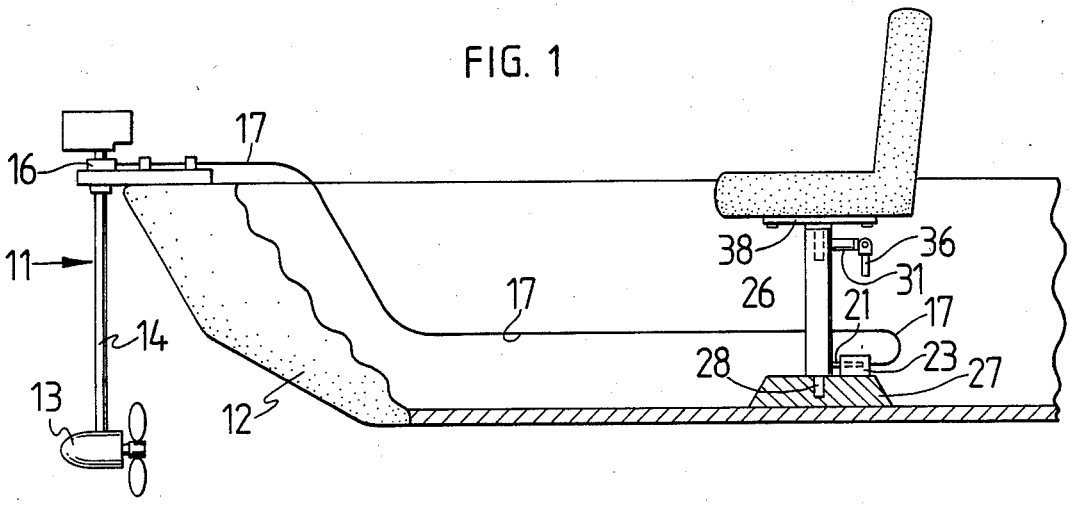
FIG. 1 is an elevational view, partly broken away and in section, showing my mounting structure in a boat.
Figure 3:
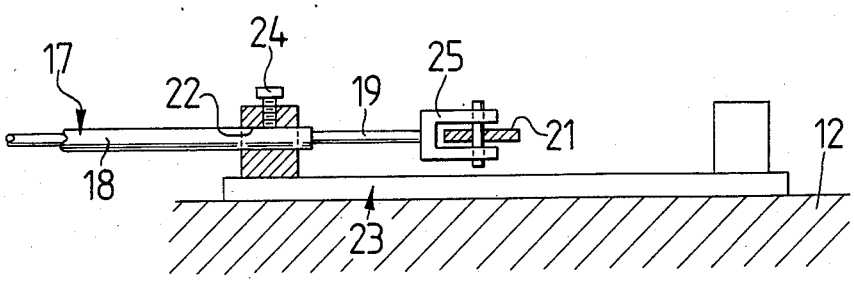
FIG. 3 is an elevational view, partly in section, showing the control arm bracket.

Referring to FIG. 1, a trolling motor 11 is conventionally mounted at the bow of the boat 12, such that its power unit 13 is supported by a shaft 14. A steering collar 16 fits around the upper portion of the shaft 14 and rotates the shaft 14 in accordance with the positioning of a cable 17 connected thereto as is well known in the art. The cable 17 is a commonly used control cable having an outer sleeve 18 and an inner wire-like member 19. The other end of the cable 17 is attached to a steering arm 21. The sleeve 18 extends through an aperture 22 in a steering arm bracket 23, as shown in FIG. 3. A set screw 24 holds the sleeve 18 motionless as the inner member 19 moves in response to movement of the steering arm 21. A connector fitting 25, such as a clevis and pin assembly, attaches the steering arm 21 to the inner member 19. The bracket 23, which is mounted to the floor of the boat 12, serves to limit the motion of the steering arm 21 to a predetermined arc between the opposite ends thereof.

Figure 2:
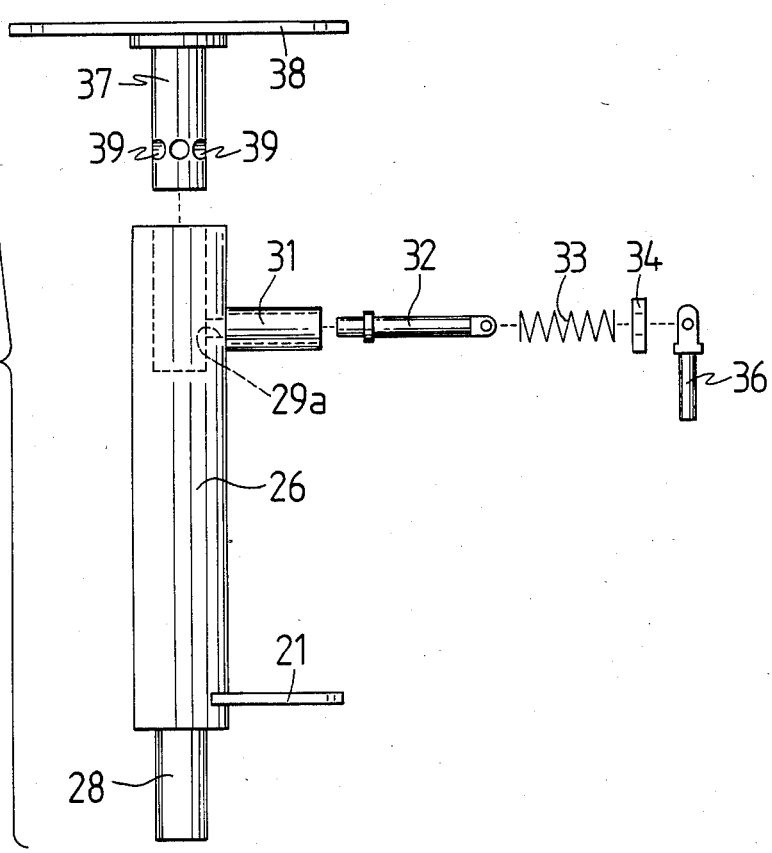
FIG. 2 is an exploded view of one embodiment of the pedestal attachment used in my invention.
Figure 5:
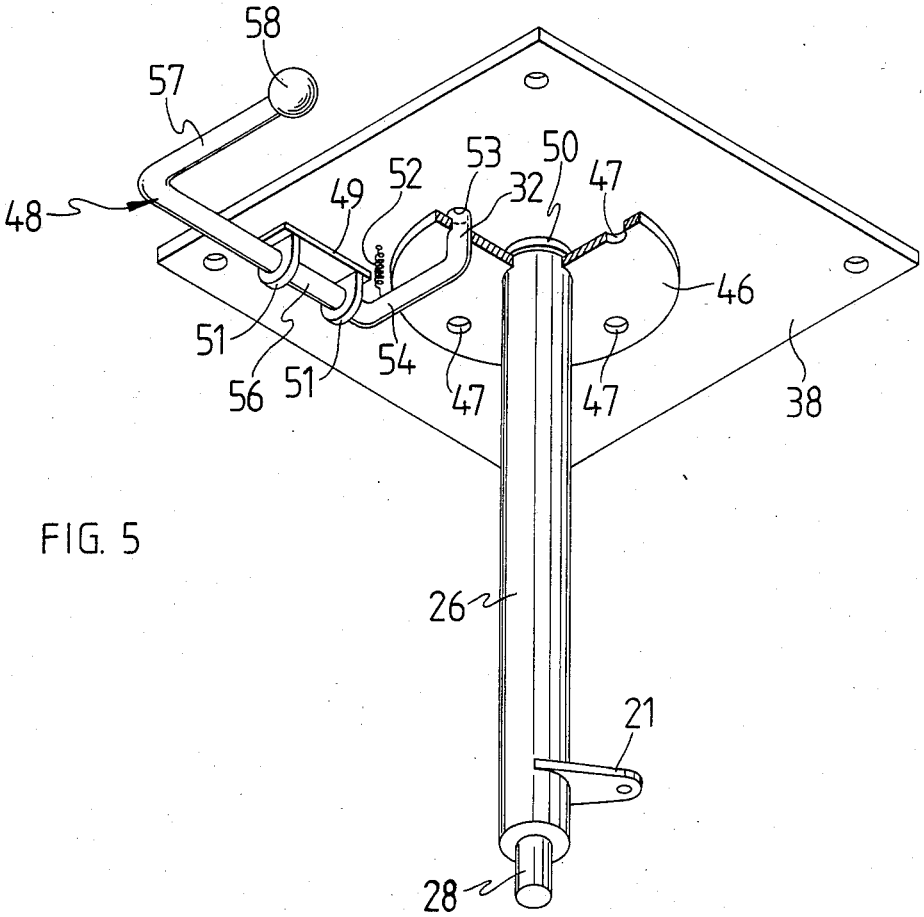
FIG. 5 is a perspective view, partly broken away and in section, of yet another embodiment of my invention.

The steering arm 21 extends radially from a seat support column 26, as shown in FIGS. 1, 2 and 5. The column 26 is mounted for rotation on a base 27 such as through the use of an axial mounting pin 28 extending into the base 27. In the embodiment shown in FIG. 2 the upper portion of column 26 has a generally cylindrical cavity 29 therein. Secured to and extending radially from the column 26 and communicating at one end with the cavity 29 by a port 29$^a$ is a sleeve 31. Within sleeve 31 is an elongated locking pin 32 which is urged toward the cavity 29 by a spring 33 mounted coaxially on the pin 32 and captured within the sleeve 31 by an end cap 34. The locking pin 32 extends through an aperture in the end cap 34 and is attached to a locking lever 36 by a pivotal roll pin connection. Lever 36 is adapted to compress spring 33 and withdraw pin 32 from cavity 29 as the lever is selectively moved from a locked to unlocked position.

Telescoping within cavity 29 is a cylindrical seat support 37 which is of a size to match cavity 29. Mounted at the top of the seat support 37 is a seat bracket 38 which secures the seat, indicated at 35, to the seat support 37. The seat support 37 hs a plurality of angularly spaced recesses 39 therein which receive the end of the locking pin 32 when lever 36 is in the locked position. Although any number of recesses 39 may be employed, three recesses evenly spaced over an arc of 130° have proven adequate. The clindrical end of the seat support 37 may be lubricated to facilitate rotation in the cavity 29.

Figure 4:
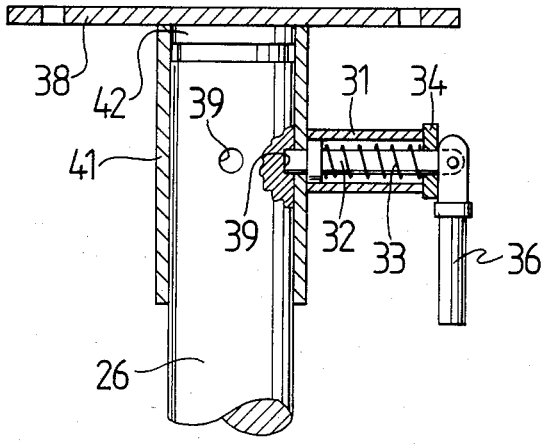
FIG. 4 is a fragmental, sectional view, of another embodixent of my invention.

In a second embodiment, shown in FIG. 4, the seat support 41 telescopies over the column 26 and carries the locking pin 32 and its associated mechanism. In this embodiment the recesses 39 are formed in column 26 and the seat support 41 is carried by a thrust bearing 42 at the upper end thereof.

In another embodiment, shown in FIG. 5, the column 26 carries an annular flange 46 which has a plurality of apertures 47 therethrough. The seat bracket 38 is rotatably mounted on the column 26 as by a bearing 50 and has a single recess 53 which aligns vertically with selected ones of the apertures 47 upon rotation of the seat. A mounting bracket extension 49 extends beneath the seat and carries a locking rod 48 which is mounted in journals 51, as shown. The locking rod is formed such that one end thereof serves as a locking pin 32 which extends upwardly toward the bottom of the seat while the remainder of the rod 48 extends generally horizontally. The pin 32 is connected to a first leg 54 which is offset from a pivot region 56 which is held in the journals 51. A second leg 57, also offset from the pivot region 56, carries a handle 58 at its distal end. Vertical movement of the handle 58 causes corresponding movement of the pin 32 such that the pin 32 is inserted and retracted from the apertures 47 and recess 53. The rod 58 is normally biased for engagement at pin 32 with an aperture 47 and recess 56 by suitable means, such as a leaf spring or tension spring, shown generally at 52.

Each embodiment of my invention operates in the same way. That is, the locking pin 32 is baised toward engagement with the apertures 47 and recess 53 and locks the seat support to the column. In this condition the steering arm 21 moves through the same arc as the seat and registers the same angular displacement. This angular displacement is transmitted to the steering collar 16 so that when the seat turns the trolling motor 11 also turns. When the locking pin 32 is retracted the seat is free to turn without turning the column 26 or the motor 11. By engaging the locking pin through one of the offset apertures 47 and the recess 53, the fisherman may face outboard of the boat 12 while he steers the boat with his seat. This allows him to comfortably fish toward the shoreline or any other fish cover while maintaining complete control of the boat. It should be noted that the trolling motor 11 has on/off and speed controls which can be conveniently mounted either to a cover, not shown, on the steering arm bracket 23 or at any other convenient location.

While I have shown my invention in various forms, it will be obvious to those skilled in the art that it is not so limited, but is susceptible of various other changes and modifications without departing from the spirit thereof.

What I claim is:

1. In a trolling motor guide for use with a motor mounted to a boat wherein the occupant sits in a rotatable seat the improvement comprising:

(a) means operatively connected to said seat for registering angular displacement of said seat from a predetermined position including a pedestal rotatably mounted to said boat and supporting said seat such that said seat and pedestal rotate concomitantly while said means for registering is connected to said seat and a steering arm extending radially from said pedestal and movable therewith;

(b) means operatively connected to said means for registering for changing the position of said motor in accordance with the angular displacement of said seat; and (c) means for selectively disconnecting said means for registering from said seat including support means for said seat mounted on said pedestal and rotatable relative thereto and also operatively connected in fixed relation to said seat for rotation therewith with said pedestal and said support means having at least one radially opening aperture therein with said apertures being cooperatively positioned, and means for detachably connecting said support means to said pedestal for concomitant rotation therewith including a radially extending pin urged toward simultaneous engagement with said apertures in said support means and pedestal and adapted for selective disengagement from at least one of said apertures.

2. Apparatus for controlling the angular position of a cable steerable trolling motor on a boat in accordance with the angular displacement of an occupant's seat comprising, in combination:

(a) a pedestal carrying said seat and rotatably mounted to said boat;

(b) steering means connected to said pedestal and said motor for registering the angular displacement of said pedestal from a predetermined position; and (c) means for connecting said seat to said pedestal whereby said seat releasably engages said pedestal for concomitant rotation therewith with said pedestal and said means for connecting said seat thereon are telescopically and rotatably connected and each having at least one aperture therein with said apertures being selectively aligned by relative rotation of said means for connecting and said pedestal with said means for connecting including a retractable radially extending pin urged toward insertion through said apertures.

3. Apparatus for controlling the angular position of a cable steerable trolling motor on a boat in accordance with the angular displacement of the occupant's seat comprising, in combination:

(a) a pedestal carrying said seat and rotatably mounted to said boat;

(b) steering means connected to said pedestal and said motor for registering the angular displacement of said pedestal from a predetermined position; and (c) means for connecting said seat to said pedestal, whereby said seat releasably engages said pedestal for concomitant rotation therewith, including a radially extending annular flange mounted on said pedestal proximal said seat having at least one aperture therethrough, a seat bracket rotatably carried by said pedestal and affixed to said seat having at least one aperture therein for cooperative vertical alignment with said aperture in said flange, and a locking pin retractably urged toward insertion through both of said apertures.

* * * * *